US011198147B2

(12) United States Patent
Zeng et al.

(10) Patent No.: US 11,198,147 B2
(45) Date of Patent: Dec. 14, 2021

(54) LIQUID PHOTOCURABLE ADHESIVE COATING DEVICE AND METHOD

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventors: Mu Zeng, Beijing (CN); Tao Wang, Beijing (CN); Guowen Yang, Beijing (CN); Se Hyuck Park, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 326 days.

(21) Appl. No.: 15/548,517

(22) PCT Filed: Feb. 6, 2017

(86) PCT No.: PCT/CN2017/072984
§ 371 (c)(1),
(2) Date: Aug. 3, 2017

(87) PCT Pub. No.: WO2017/197927
PCT Pub. Date: Nov. 23, 2017

(65) Prior Publication Data

US 2018/0236482 A1 Aug. 23, 2018

(30) Foreign Application Priority Data

May 16, 2016 (CN) ..... 201610323302.1

(51) Int. Cl.
*B05C 9/14* (2006.01)
*B05D 3/06* (2006.01)
(Continued)

(52) U.S. Cl.
CPC ..... *B05C 9/14* (2013.01); *B05C 5/0216* (2013.01); *B05D 1/26* (2013.01); *B05D 3/062* (2013.01); *B05D 3/067* (2013.01)

(58) Field of Classification Search
None
See application file for complete search history.

(56) References Cited

U.S. PATENT DOCUMENTS 4,908,231 A * 3/1990 Nelson ..... F26B 3/283 118/642
4,951,600 A * 8/1990 Soshi ..... B05B 16/40 118/696
(Continued)

FOREIGN PATENT DOCUMENTS

CN 1117278 A 2/1996
CN 1532054 A 9/2004
(Continued)

OTHER PUBLICATIONS

English translation of DE10020679.*
(Continued)

*Primary Examiner* — Charles Capozzi

(57) ABSTRACT

A liquid photocurable adhesive coating device, a method for coating a liquid photocurable adhesive with a liquid photocurable adhesive coating device, and a method for coating a liquid photocurable adhesive are provided. The liquid photocurable adhesive coating device, including: a coating head, configured to coat a liquid photocurable adhesive; a precuring light source, fixed on the coating head and configured to precure the liquid photocurable adhesive coated by the coating head while the coating head is coating the liquid photocurable adhesive.

15 Claims, 4 Drawing Sheets

(51) Int. Cl.
*B05C 5/02* (2006.01)
*B05D 1/26* (2006.01)

(56) References Cited

U.S. PATENT DOCUMENTS

| | | | | |
|---|---|---|---|---|
| 5,348,604 | A | 9/1994 | Neff | |
| 5,836,068 | A * | 11/1998 | Bullen | B23Q 11/06 29/430 |
| 6,174,932 | B1 * | 1/2001 | Paehl | C08F 283/10 427/487 |
| 2004/0028830 | A1 * | 2/2004 | Bauer | B05B 13/0468 427/256 |
| 2005/0081784 | A1 | 4/2005 | Sakayori et al. | |
| 2007/0052787 | A1 | 3/2007 | Miura et al. | |
| 2009/0011143 | A1 | 1/2009 | Yatsunami et al. | |
| 2010/0178433 | A1 | 7/2010 | Wang et al. | |
| 2011/0097499 | A1 | 4/2011 | Park et al. | |
| 2011/0135841 | A1 | 6/2011 | Thijssen | |
| 2015/0367788 | A1 | 12/2015 | Hudina et al. | |
| 2016/0368005 | A1 * | 12/2016 | Pajel | B05C 9/12 |
| 2017/0157637 | A1 * | 6/2017 | Jurcevic | B05C 17/0052 |

FOREIGN PATENT DOCUMENTS

| | | | | |
|---|---|---|---|---|
| CN | 1620340 | A | | 5/2005 |
| CN | 101382633 | A | | 3/2009 |
| CN | 201308881 | Y | * | 9/2009 |
| CN | 201308881 | Y | | 9/2009 |
| CN | 101676802 | A | | 3/2010 |
| CN | 102049368 | A | | 5/2011 |
| CN | 102112281 | A | | 6/2011 |
| CN | 102909164 | A | | 2/2013 |
| CN | 105102136 | A | | 11/2015 |
| CN | 105772340 | A | | 7/2016 |
| DE | 19720894 | A1 | | 11/1997 |
| DE | 10020679 | A1 | | 11/2001 |
| DE | 10020679 | A1 | * | 11/2001 ..... B05D 3/0227 |
| DE | 202013103105 | U1 | | 11/2014 |
| EP | 1452326 | A2 | | 9/2004 |
| JP | 04268086 | A | | 9/1992 |
| JP | 3868298 | B2 | | 1/2007 |
| JP | 2009000636 | A | | 1/2009 |
| JP | 2010-012391 | A | | 1/2010 |
| JP | 2012-143691 | A | | 8/2012 |
| JP | 2013-094742 | A | | 5/2013 |
| WO | 2006/075421 | A1 | | 7/2006 |
| WO | 2009/136861 | A1 | | 11/2009 |

OTHER PUBLICATIONS

RobotWorx ABB IRB 2000 Datasheet (Robot Information).*
The International Search Report and Written Opinion dated May 12, 2017; PCT/CN2017/072984.
The First Chinese Office Action dated Oct. 23, 2017; Appln. No. 201610323302.1.
The Second Chinese Office Action dated Jun. 4, 2018; Appln. No. 201610323302.1.
The Third Chinese Offce Action dated Oct. 9, 2018; Appln. No. 201610323302.1.
Extended European Search Report dated Dec. 19, 2019; Appln. No. 17742638.4.

* cited by examiner

LIQUID PHOTOCURABLE ADHESIVE COATING DEVICE AND METHOD

TECHNICAL FIELD

Embodiments of the present disclosure relate to a liquid photocurable adhesive coating device, a method for coating a liquid photocurable adhesive with a liquid photocurable adhesive coating device, and a method for coating a liquid photocurable adhesive.

BACKGROUND

In recent years, with constant development of a display technology, a curved display with both a display screen and a backlight source being inwardly concave gradually appears in the market. Since the display screen of the curved display is an arc-shaped design that an entire screen surrounds toward a viewer, it can provide a wide viewing angle and a wide panoramic image effect, so that the curved display brings a more natural and comfortable sensory experience to a user.

SUMMARY

At least one embodiment of the present disclosure provides a liquid photocurable adhesive coating device, a method for coating a liquid photocurable adhesive with a liquid photocurable adhesive coating device, and a method for coating a liquid photocurable adhesive. The liquid photocurable adhesive coating device can coat the liquid photocurable adhesive, and at the same time, precure the liquid photocurable adhesive, to deprive it of flowability, so that it is possible to implement coating the liquid photocurable adhesive on a curved surface At least one embodiment of the present disclosure provides a liquid photocurable adhesive coating device, including: a coating head, configured to coat a liquid photocurable adhesive; a precuring light source, fixed on the coating head and configured to precure the liquid photocurable adhesive coated by the coating head while the coating head is coating the liquid photocurable adhesive.

For example, in the liquid photocurable adhesive coating device provided by an embodiment of the present disclosure, the precuring light source is configured to emit parallel curing light.

For example, in the liquid photocurable adhesive coating device provided by an embodiment of the present disclosure, a light emergent direction of the precuring light source coincides with an outflow direction of the liquid photocurable adhesive in the coating head.

For example, in the liquid photocurable adhesive coating device provided by an embodiment of the present disclosure, the procuring light source is provided on an outer surface of the coating head.

For example, in the liquid photocurable adhesive coating device provided by an embodiment of the present disclosure, the coating head includes a liquid photocurable adhesive channel, and the precuring light source is provided in a position of the outer surface of the coating head closest to the liquid photocurable adhesive channel.

For example, the liquid photocurable adhesive coating device provided by an embodiment of the present disclosure further includes: a coating head moving mechanism, wherein, the coating head moving mechanism is connected with the coating head, and includes a rotating mechanism configured to rotate the coating head.

For example, in the liquid photocurable adhesive coating device provided by an embodiment of the present disclosure, the coating head moving mechanism further includes: a first propelling mechanism, configured to move the coating head in a first direction; and a second propelling mechanism, configured to move the coating head in a second direction.

For example, in the liquid photocurable adhesive coating device provided by an embodiment of the present disclosure, the first propelling mechanism is connected with the rotating mechanism, the first propelling mechanism moves the coating head in the first direction by moving the rotating mechanism; the second propelling mechanism is connected with the first propelling mechanism, and the second propelling mechanism moves the coating head in the second direction by moving the first propelling mechanism.

For example, in the liquid photocurable adhesive coating device provided by an embodiment of the present disclosure, the rotating mechanism is configured to rotate about an axis perpendicular to a plane where the first direction and the second direction are located.

For example, in the liquid photocurable adhesive coating device provided by an embodiment of the present disclosure, a size of a light outlet of the precuring light source in a direction perpendicular to the plane where the first direction and the second direction are located is larger than or equal to a size of an adhesive outlet of the coating head in the direction perpendicular to the plane where the first direction and the second direction are located.

For example, in the liquid photocurable adhesive coating device provided by an embodiment of the present disclosure, the first propelling mechanism includes a first-direction lead screw; and the second propelling mechanism includes a second-direction lead screw.

For example, in the liquid photocurable adhesive coating device provided by an embodiment of the present disclosure, the precuring light source includes a laser emitter.

For example, in the liquid photocurable adhesive coating device provided by an embodiment of the present disclosure, the precuring light source includes a curing lamp and a light-shielding plate, the light-shielding plate wrapping the curing lamp so that the precuring light source emits parallel curing light.

For example, in the liquid photocurable adhesive coating device provided by an embodiment of the present disclosure, a side of the light-shielding plate close to the curing lamp is provided with a reflective film.

At least one embodiment of the present disclosure provides a method for coating a liquid photocurable adhesive with a liquid photocurable adhesive coating device, wherein, the liquid photocurable adhesive coating device comprises: a coating head, configured to coat the liquid photocurable adhesive on a substrate to be coated; and a precuring light source, fixed on the coating head and configured to precure the liquid photocurable adhesive coated by the coating head while the coating head is coating the liquid photocurable adhesive, and the method for coating the liquid photocurable adhesive with the liquid photocurable adhesive coating device includes: coating the liquid photocurable adhesive on the substrate to be coated with the coating head; and precuring the liquid photocurable adhesive with the precuring light source, wherein, the coating the liquid photocurable adhesive on the substrate to be coated with the coating head and the precuring the liquid photocurable adhesive with the precuring light source are performed simultaneously.

For example, in the method for coating the liquid photocurable adhesive with the liquid photocurable adhesive coating device provided by an embodiment of the present disclosure, the substrate to be coated includes a curved surface.

For example, in the method for coating the liquid photocurable adhesive with the liquid photocurable adhesive coating device provided by an embodiment of the present disclosure, a light emergent direction of the precuring light source coincides with an outflow direction of the liquid photocurable adhesive in the coating head; the liquid photocurable adhesive coating device further comprises: a coating head moving mechanism connected with the coating head and including a rotating mechanism configured to rotate the coating head; in a procedure of coating the liquid photocurable adhesive on the substrate to be coated with the coating head, the coating head moving mechanism is configured to keep a coating velocity of the coating head with respect to a coated surface of the substrate to be coated to be constant.

For example, in the method for coating the liquid photocurable adhesive with the liquid photocurable adhesive coating device provided by an embodiment of the present disclosure, the coating head moving mechanism further includes: a first propelling mechanism, configured to move the coating head in a first direction; and a second propelling mechanism, configured to move the coating head in a second direction; the curved surface includes a curved sub-surface with a curvature r; and the method for coating the liquid photocurable adhesive with the liquid photocurable adhesive coating device further includes: determining a coating velocity V of the coating head with respect to a surface of the substrate to be coated; determining an angular velocity co of the rotating mechanism according to a distance d from a coating end point of the coating head to the coated surface of the substrate to be coated, the curvature r of the curved sub-surface and the coating velocity V; and determining velocities v1 and v2 of the first propelling mechanism and the second propelling mechanism, according to component velocities Vx and Vy of the coating velocity V in the first direction and the second direction, the distance d from the coating end point of the coating head to the coated surface of the substrate to be coated, a distance R from an axis of the rotating mechanism to the coating end point of the coating head, and the curvature r of the curved sub-surface, so that the coating velocity of the coating head with respect to the coated surface of the substrate to be coated is kept constant.

For example, in the method for coating the liquid photocurable adhesive with the liquid photocurable adhesive coating device provided by an embodiment of the present disclosure, in a procedure of coating the liquid photocurable adhesive on the substrate to be coated with the coating head, the outflow direction of the liquid photocurable adhesive is made perpendicular to the coated surface of the substrate to be coated by using the coating head moving mechanism.

For example, in the method for coating the liquid photocurable adhesive with the liquid photocurable adhesive coating device provided by an embodiment of the present disclosure, in the procedure of coating the liquid photocurable adhesive on the substrate to be coated with the coating head, the distance between the coating head and the coated surface of the substrate to be coated is kept constant by using the coating head moving mechanism.

At least one embodiment of the present disclosure provides a method for coating liquid photocurable adhesive, including: coating the liquid photocurable adhesive on a substrate to be coated; and precuring the liquid photocurable adhesive, wherein, the coating the liquid photocurable adhesive onto the substrate to be coated and the precuring the liquid photocurable adhesive are performed simultaneously.

For example, in the method for coating the liquid photocurable adhesive provided by an embodiment of the present disclosure, the substrate to-be-coated includes a curved surface.

For example, in the method for coating the liquid photocurable adhesive provided by an embodiment of the present disclosure, in a procedure of coating the liquid photocurable adhesive on the substrate to be coated, the coating velocity is kept constant.

For example, in the method for coating the liquid photocurable adhesive provided by an embodiment of the present disclosure, in the procedure of coating the liquid photocurable adhesive on the substrate to be coated, the outflow direction of the liquid photocurable adhesive is perpendicular to the coated surface of the substrate to be coated.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

REFERENCE SIGNS

Figure 1:
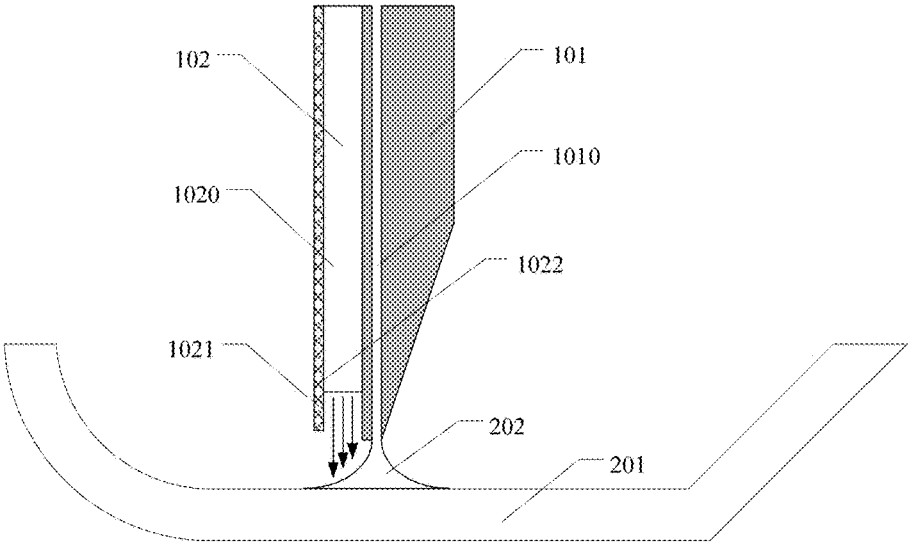
FIG. 1 is a structural schematic diagram of a liquid photocurable adhesive coating device provided by an embodiment of the present disclosure.

101—coating head; 1010—photocurable adhesive channel; 1012—adhesive outlet; 102—precuring light source; 1020—curing lamp; 1021—light-shielding plate; 1022—reflective film; 1023—light outlet; 103—coating head moving mechanism, 1030—rotating mechanism, 1031—first propelling mechanism; and 1032—second propelling mechanism.

DETAILED DESCRIPTION

In order to make objects, technical details and advantages of the embodiments of the present invention apparent, the technical solutions of the embodiment will be described in a clearly and fully understandable way in connection with the drawings related to the embodiments of the present invention. It is obvious that the described embodiments are just a part but not all of the embodiments of the present invention. Based on the described embodiments herein, those skilled in the art can obtain other embodiment(s), without any inventive work, which should be within the scope of the present invention.

Unless otherwise specified, the technical terms or scientific terms here should be of general meanings as understood by those ordinarily skilled in the art. In the specification and claims of the present invention of the patent application, words such as "first", "second" and the like do not denote any order, quantity, or importance, but rather are used for distinguishing different components. Words such as "include" or "comprise" and the like denote that elements or objects appearing before the words of "include" or "comprise" cover the elements or the objects enumerated after the words of "include" or "comprise" or equivalents thereof, not exclusive of other elements or objects. "Connected" or "coupled" or similar words are not limited to physical or mechanical connection, and may comprise electrical connection, either direct or indirect connection. Words such as "up", "down", "left", "right", "horizontal", "vertical" and the like are only used for expressing relative positional relationship, when the absolute position of a described object is changed, the relative positional relationship may also be correspondingly changed.

In research, inventors of the present application found that because after liquid optical adhesive is coated on a surface of a curved substrate, it can flow, resulting problems such as inconsistent thickness of the liquid optical adhesive cured, solid optical adhesive is used as an optical adhesive for bonding a curved surface of a curved display, and the liquid optical adhesive is not used. However, as compared with the liquid optical adhesive, the solid optical adhesive will cause increased costs in use, transportation, inventory, and other aspects, a slightly inferior optical picture characteristic, as well as a larger interior stress of a product during bonding.

Embodiments of the present disclosure provide a liquid photocurable adhesive coating device, a method for coating liquid photocurable adhesive with the liquid photocurable adhesive coating device, and a method for coating a liquid photocurable adhesive. The liquid photocurable adhesive coating device includes a coating head configured to coat liquid photocurable adhesive and a precuring light source configured to precure the liquid photocurable adhesive coated by the coating head, so as to deprive the liquid photocurable adhesive of flowability. The liquid photocurable adhesive coating device can coat the liquid photocurable adhesive, and at the same time, precure the liquid photocurable adhesive, to deprive it of flowability, so that it is possible to implement coating the liquid photocurable adhesive on the curved surface.

Hereinafter, the liquid photocurable adhesive coating device, the method for coating the liquid photocurable adhesive with the liquid photocurable adhesive coating device, and the method for coating the liquid photocurable adhesive provided by the embodiments of the present disclosure will be illustrated in conjunction with the drawings.

Embodiment One

This embodiment provides a liquid photocurable adhesive coating device, the liquid photocurable adhesive coating device comprising a coating head 101 and a precuring light source 102. The coating head 101 is used for coating liquid photocurable adhesive 202; the precuring light source 102 is fixed onto the coating head 101 and is configured to precure the liquid photocurable adhesive 202 coated by the coating head 101 while the coating head 101 is coating the liquid photocurable adhesive 202.

As shown in FIG. 1, the precuring light source 102 is fixed onto the coating head 101, and the coating head 101 can coat the liquid photocurable adhesive 202 onto a substrate to be coated 201; the precuring light source 102 may emit curing light to precure the liquid photocurable adhesive 202 coated by the coating head 101 on the substrate to be coated 201 and deprive it of flowability, so that the liquid photocurable adhesive 202 coated on the curved surface no longer flows, so that coating the liquid photocurable adhesive on the curved surface can be implemented. It should be noted that, the above-described precuring light source 102 does not completely cure the liquid photocurable adhesive 202, but only cures the liquid photocurable adhesive 202 to an extent to deprive it of flowability. In addition, the above-described curved surface includes, but is not limited to, an arc-shaped surface, but may also include other curved surface, for example, a folded surface.

For example, the liquid photocurable adhesive 202 may be liquid optical adhesive, photoresist, and the like.

For example, the substrate to be coated 201 may be a cover plate of a display screen.

In the liquid photocurable adhesive coating device provided in this embodiment, by combination of the coating head and the precuring light source together, it is possible to simultaneously performing coating the liquid photocurable adhesive and precuring, so that the liquid photocurable adhesive coated on the curved surface no longer flows, so that coating the liquid photocurable adhesive on the curved surface can be implemented. In addition, by keeping a distance of the coating head with respect to the substrate to be coated and a coating velocity to be consistent, a curing rate of the liquid photocurable adhesive coated on the substrate to be coated may be kept consistent, so as to form a liquid photocurable adhesive layer with a uniform thickness. It should be noted that, the above-described coating velocity refers to a moving velocity of the coating head with respect to the substrate to be coated.

For example, in the liquid photocurable adhesive coating device provided in an example of this embodiment, as shown in FIG. 1, the precuring light source 102 is configured to emit parallel curing light. Because the precuring light source 102 emits the parallel curing light, a size of the parallel curing light emitted by the precuring light source 102 within a plane parallel to the substrate to be coated 201 may be adjusted according to needs, so as to irradiate only to-be-precured liquid photocurable adhesive 202, without affecting liquid photocurable adhesive 202 in other position of the substrate to be coated 201. It should be noted that, the above-described parallel curing light is defined with respect to diverging light, and includes, but is not limited to, strictly parallel light, and may also include parallel light within a certain error range.

For example, in the liquid photocurable adhesive coating device provided in an example of this embodiment, as shown in FIG. 1, a light emergent direction of the precuring light source 101 coincides with an outflow direction of the liquid photocurable adhesive 202 in the coating head 102. Thus, since the precuring light source 102 is fixed on the coating head 101 and the light emergent direction of the precuring light source 101 coincides with the outflow direction of the liquid photocurable adhesive 202 in the coating head 102, the precuring light source 102 may be move along with the coating head 101, so as to precure the liquid photocurable adhesive 202 coated by the coating head 101 in time. Of course, this embodiment includes, but is not limited thereto. The precuring light source may also not be fixed on the coating head, for example, the precuring light source may be provided separately; in this case, the precuring light source precuring the liquid photocurable adhesive may be performed simultaneously with the coating head 102 coating the liquid photocurable adhesive by adjusting its own position and a light emergent angle. That is, when the coating head is coating the liquid photocurable adhesive on the substrate to be coated, by adjusting the position and the light emergent angle of the precuring light source, light spot projected by the precuring light source on the substrate to be coated may move along with the coating head, so as to timely deprive the photocurable adhesive coated on the substrate to be coated of flowability, so that the liquid photocurable adhesive coated on the curved surface no longer flows, and the liquid photocurable adhesive layer with the uniform thickness can be formed. As compared with the above-described case, the liquid photocurable adhesive coating device provided in the example has a simpler structure, and does not require separate control of the position and the angle of the precuring light source.

For example, in the liquid photocurable adhesive coating device provided in an example of this embodiment, as shown in FIG. 1, the precuring light source 102 is provided on an outer surface of the coating head 101. Thus, after the coating head 101 coats the liquid photocurable adhesive 202 on the substrate to be coated 201, the precuring light source 102 can rapidly precure the liquid photocurable adhesive 202 and deprive it of flowability, to ensure that it does not flow on the substrate to be coated 201, so as to avoid the problem of nonuniform thickness of the liquid optical adhesive.

For example, in the liquid photocurable adhesive coating device provided in an example of this embodiment, as shown in FIG. 1 the coating head 101 includes a liquid photocurable adhesive channel 1010, and the precuring light source 102 is provided in a position on the outer surface of the coating head 101 closest to the liquid photocurable adhesive channel 1010. That is, when the coating head 101 includes the liquid photocurable adhesive channel 1010 and the liquid photocurable adhesive channel 1010 is provided in a non-center position of the coating head 101, for example, as shown in FIG. 1, the liquid photocurable adhesive channel 1010 is provided at a position close to one side of the outer surface of the coating head 101. In this case, the precuring light source 102 may be correspondingly provided in a position of the outer surface of the one side of the coating head 101 closest to the liquid photocurable adhesive channel 1010, that is, a position where a distance between the outer surface of the coating head 101 and a surface of the liquid photocurable adhesive channel 1010 is the smallest. Thus, a precuring velocity of the liquid photocurable adhesive 202 by the precuring light source 102 may be further improved, after the coating head 101 coats the liquid photocurable adhesive 202 on the substrate to be coated 201; That is, after the coating head 101 coats the liquid photocurable adhesive 202 on the substrate to be coated 201, the precuring light source 102 may immediately precure the coated liquid photocurable adhesive 202, so as to further prevent the liquid photocurable adhesive 202 from flowing on the substrate to be coated 201. It should be noted that, the liquid photocurable adhesive channel is a channel for the liquid photocurable adhesive in the coating head to flow out.

For example, in the liquid photocurable adhesive coating device provided in an example of this embodiment, the precuring light source 102 includes a laser emitter. Thus, the precuring light source 102 may emit parallel curing light.

For example, in the liquid photocurable adhesive coating device provided in an example of this embodiment, as shown in FIG. 1, the precuring light source 102 includes a curing lamp 1020 and a light-shielding plate 1021, the light-shielding plate 1021 wraps the curing lamp 1020 so that the precuring light source 102 emits parallel curing light. It should be noted that, a length of the light-shielding plate 1021 in the light emergent direction of the precuring light source 102 may be larger than a length of the curing lamp 1020, so as to improve parallelism of the parallel curing light emitted by the precuring light source 102. In addition, the above-described "wrap" is not limited to fully wrap, and may also include half wrap. For example, a side of the curing lamp 1020 close to the coating head 101 may be shielded with the coating head 101, without additional formation of the light-shielding plate 1021.

For example, in the liquid photocurable adhesive coating device provided in an example of this embodiment, as shown in FIG. 1, a side of the light-shielding plate 1021 close to the curing lamp 1020 is provided with a reflective film 1022. It should be noted that, when a side of the light-shielding plate 1021 close to the curing lamp 1020 is provided with the reflective film 1022, the reflective film 1022 may reflect light in directions other than the light emergent direction of the precuring light source 102 emitted by the curing lamp 1020, so that light is emitted in the light emergent direction of the precuring light source 102, so as to improve utilization efficiency of light emitted by the curing lamp 1020.

For example, in the liquid photocurable adhesive coating device provided in an example of this embodiment, the curing lamp 1020 is an LED curing lamp.

Figure 2:
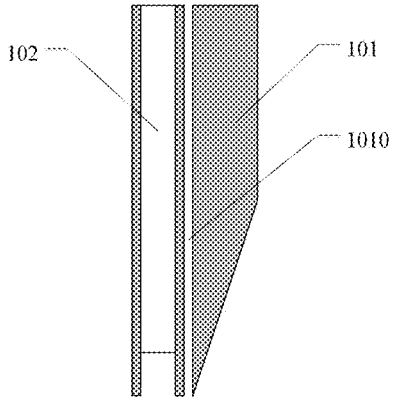
FIG. 2 is a structural schematic diagram of another liquid photocurable adhesive coating device provided by an embodiment of the present disclosure.

For example, in the liquid photocurable adhesive coating device provided in an example of this embodiment, the precuring light source 102 and the coating head 101 may be integrally formed. For example, as shown in FIG. 2, the precuring light source 102 is formed inside the coating head 101. It should be noted that, when the precuring light source 102 is formed inside the coating head 101, in order to improve the utilization efficiency of light emitted by the precuring light source 102, an inner wall of the coating head 101 wrapping the precuring light source 102 may be provided with a reflective film as well.

Figure 3:
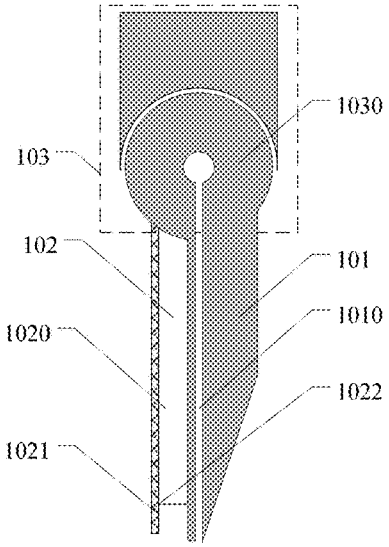
FIG. 3 is a structural schematic diagram of another liquid photocurable adhesive coating device provided by an embodiment of the present disclosure.

For example, as shown in FIG. 3, the liquid photocurable adhesive coating device provided in an example of this embodiment further includes: a coating head moving mechanism 103, connected with the coating head 101 and including a rotating mechanism 1030 configured to rotate the coating head 101. The coating head moving mechanism 103 is used for moving the coating head 101, so as to coat the liquid photocurable adhesive onto various substrate to be coated. The rotating mechanism 1030 may mobilize the coating head 101 to perform coating on the curved surface.

Figure 4:
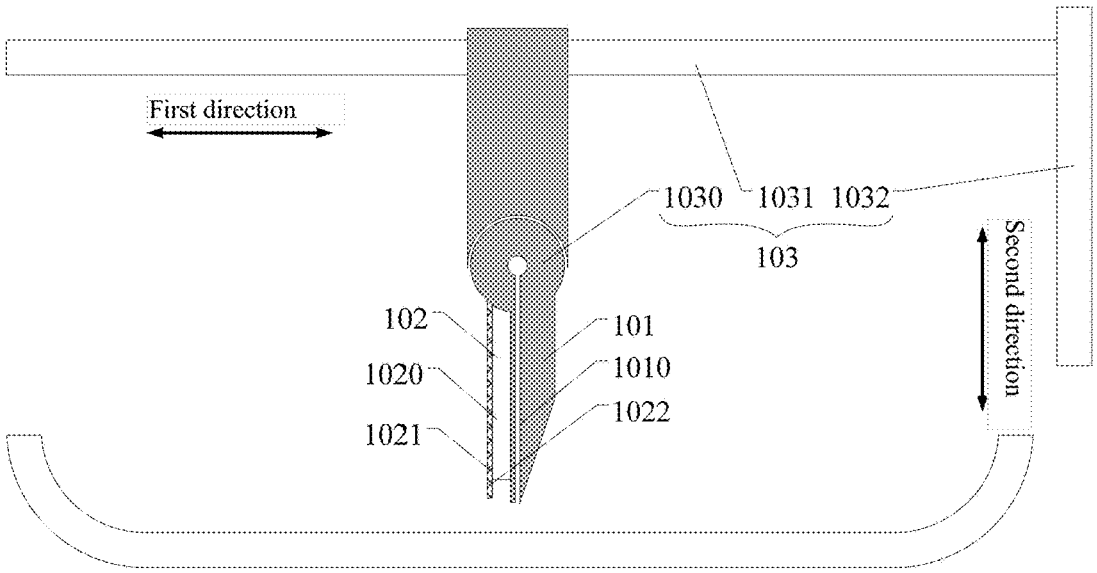
FIG. 4 is a structural schematic diagram of another liquid photocurable adhesive coating device provided by an embodiment of the present disclosure.
Figure 5:
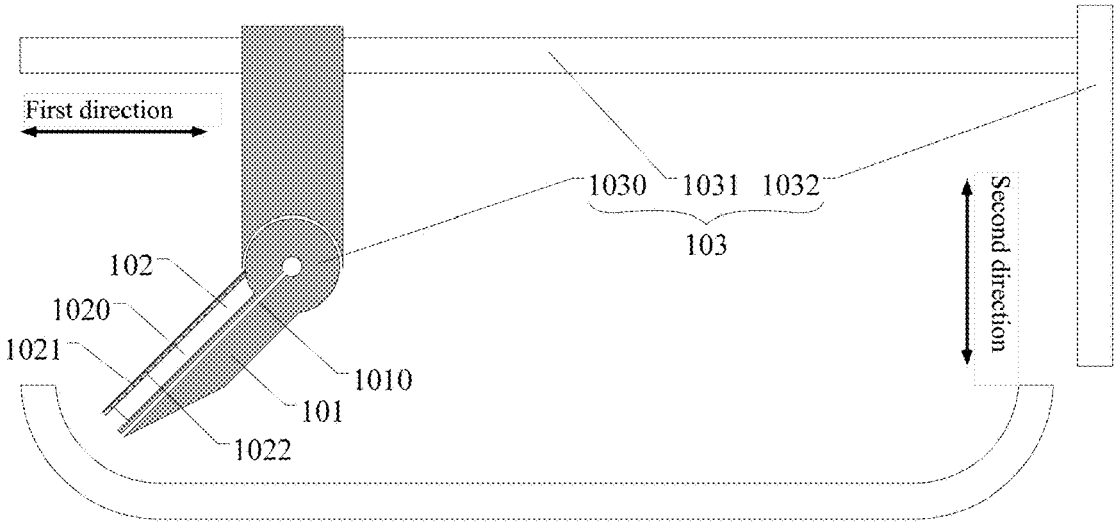
FIG. 5-6 is a schematic diagram of coating liquid photocurable adhesive with a liquid photocurable adhesive coating device provided by an embodiment of the present disclosure.
Figure 6:
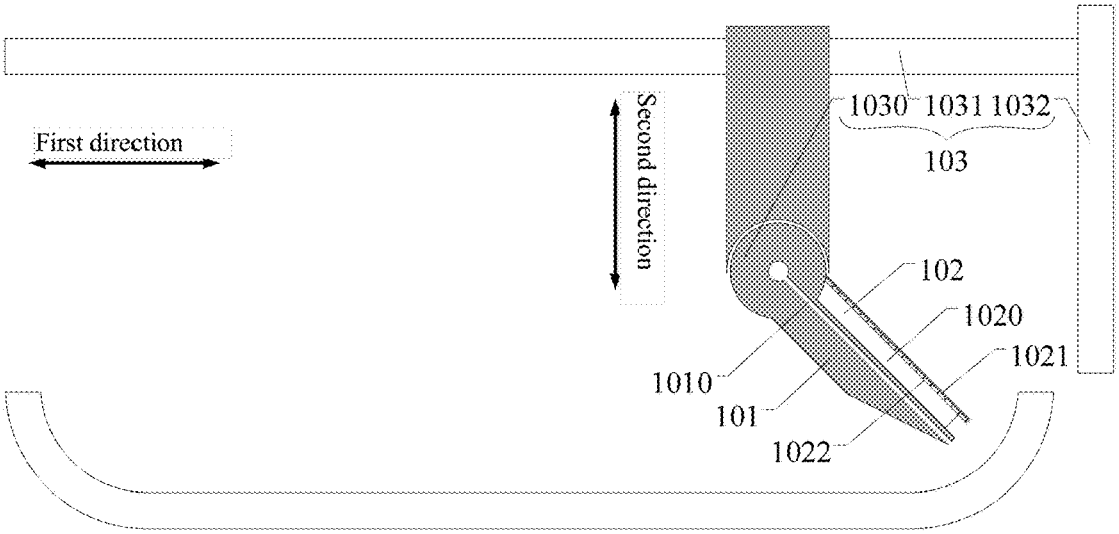

For example, as shown in FIG. 4 to FIG. 6, in the liquid photocurable adhesive coating device provided in an example of this embodiment, the coating head moving mechanism 103 further includes: a first propelling mechanism 1031 configured to make the coating head 101 to move in a first direction; and a second propelling mechanism 1032 configured to make the coating head 101 to move in a second direction.

For example, as shown in FIG. 4 to FIG. 6, in the liquid photocurable adhesive coating device provided in an example of this embodiment, the first propelling mechanism 1031 is connected with the rotating mechanism 1030, the first propelling mechanism 1031 makes the coating head 101 to move in the first direction by moving the rotating mechanism 1030; the second propelling mechanism 1032 is connected with the first propelling mechanism 1031, and the second propelling mechanism 1032 makes the coating head 101 to move in the second direction by move the first propelling mechanism 1031. Of course, this embodiment includes, but is not limited to, the above-described connection mode, for example, the second propelling mechanism 1032 may also be connected with the rotating mechanism 1030, and the second propelling mechanism 1032 makes the coating head 101 to move in the second direction by moving the rotating mechanism 1030; the first propelling mechanism 1031 may also be connected with the second propelling mechanism 1032, and the first propelling mechanism 1031 makes the coating head 101 to move in the first direction by moving the second propelling mechanism 1032.

For example, as shown in FIG. 4 to FIG. 6, in the liquid photocurable adhesive coating device provided in an example of this embodiment, the rotating mechanism 1030 is configured to rotate about an axis perpendicular to a plane formed by the first direction and the second direction. Thus, the rotating mechanism 1030 can drive the coating head 101 to rotate in the plane formed by the first direction and the second direction.

Figure 7:
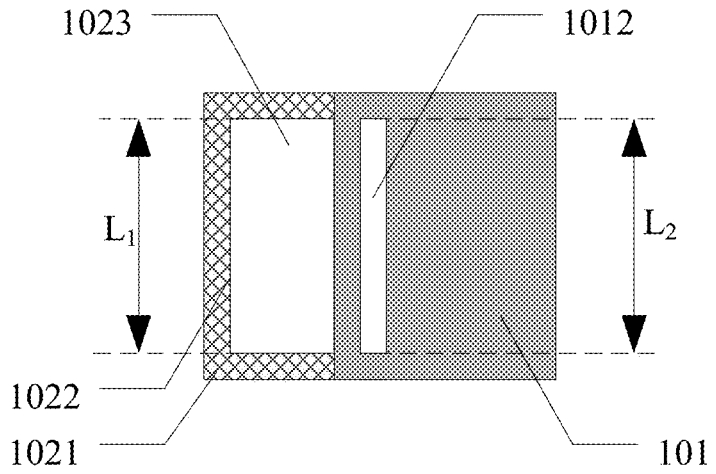
FIG. 7 is a bottom view of a liquid photocurable adhesive coating device provided by an embodiment of the present disclosure.

For example, as shown in FIG. 7, in the liquid photocurable adhesive coating device provided in an example of this embodiment, a size L1 of a light outlet 1023 of the precuring light source 102 in a direction perpendicular to the plane where the first direction and the second direction are located is equal to a size L2 of an adhesive outlet 1023 of the coating head 101 in the direction perpendicular to the plane where the first direction and the second direction are located. Thus, the precuring light source 102 may exactly cure the liquid photocurable adhesive coated by the coating head 101. It should be noted that, this embodiment includes, but is not limited thereto, for example, when the liquid photocurable adhesive coating device provided in this embodiment is used for coating a linear liquid photocurable adhesive pattern, the size of the light outlet of the precuring light source in the direction perpendicular to the plane where the first direction and the second direction are located may also be larger than the size of the adhesive outlet of the coating head in the direction perpendicular to the plane where the first direction and the second direction are located.

For example, as shown in FIG. 4 to FIG. 6, in the liquid photocurable adhesive coating device provided in an example of this embodiment, the first propelling mechanism 1031 includes a first-direction lead screw; and the second propelling mechanism 1032 includes a second-direction lead screw. As a result, the first propelling mechanism 1031 and the second propelling mechanism 1032 may move accurately. Of course, this embodiment includes, but is not limited thereto, the first propelling mechanism may include a first-direction slide rail, and the second propelling mechanism may include a second-direction slide rail.

For example, the liquid photocurable adhesive coating device provided in an example of this embodiment further comprises a curing light source, for thoroughly curing the liquid photocurable adhesive coated on the substrate to be coated.

Embodiment Two

This embodiment provides a method for coating liquid photocurable adhesive with a liquid photocurable adhesive coating device, as shown in FIG. 1, the liquid photocurable adhesive coating device comprising a coating head 101 configured to coat the liquid photocurable adhesive 202 on a substrate to be coated 201 and a precuring light source 102 fixed on the coating head 101 and configured to precure the liquid photocurable adhesive 202 coated by the coating head 101 while the coating head 101 is coating the liquid photocurable adhesive 202. The method for coating the liquid photocurable adhesive with the liquid photocurable adhesive coating device comprises steps 110 to 120 as follows:

Step 110: coating the liquid photocurable adhesive 202 on the substrate to be coated 201 with the coating head 101.

For example, the liquid photocurable adhesive 202 may be liquid optical adhesive, photoresist, and the like.

For example, the substrate to be coated 201 may be a cover plate of a display screen.

Step 120: precuring the liquid photocurable adhesive 202 with the precuring light source 102, so as to deprive the liquid photocurable adhesive 202 of flowability.

It should be noted that, the above-described precuring the liquid photocurable adhesive 202 with the precuring light source 102 is not completely curing the liquid photocurable adhesive 202, but only curing the liquid photocurable adhesive 202 to an extent to deprive it of flowability.

In the method for coating the liquid photocurable adhesive with the liquid photocurable adhesive coating device provided in this embodiment, the coating head 101 can coat the liquid photocurable adhesive 202 on the substrate to be coated 201; the precuring light source 102 can emit curing light to precure the liquid photocurable adhesive 202 coated by the coating head 101 on the substrate to be coated 201, to deprive it of flowability, so that the liquid photocurable adhesive 202 coated on the curved surface no longer flows, and coating the liquid photocurable adhesive on the curved surface can be implemented.

For example, in the method for coating the liquid photocurable adhesive with the liquid photocurable adhesive coating device provided in an example of this embodiment, the coating the liquid photocurable adhesive on the substrate to be coated with the coating head and the precuring the liquid photocurable adhesive with the precuring light source so as to deprive the liquid photocurable adhesive of flowability are performed simultaneously. Thus, after the coating head coats the liquid photocurable adhesive on the substrate to be coated, the precuring light source can immediately precure the liquid photocurable adhesive and deprive it of flowability, to ensure that it does not flow on the substrate to be coated, so as to avoid a problem of nonuniform thickness of the liquid optical adhesive.

For example, in the method for coating the liquid photocurable adhesive with the liquid photocurable adhesive coating device provided in an example of this embodiment, as shown in FIG. 1, the substrate to be coated 201 includes a curved surface.

For example, the substrate to be coated 201 may be a cover plate of a curved display screen.

In the method for coating the liquid photocurable adhesive with the liquid photocurable adhesive coating device provided in this embodiment, since the precuring light source 102 can emit curing light to precure the liquid photocurable adhesive 202 coated by the coating head 101 on the substrate to be coated 201 to deprive it of flowability, the liquid photocurable adhesive 202 will not flow on the curved surface due to gravity, so that it is possible to implement coating the liquid photocurable adhesive on the curved surface.

For example, in the method for coating the liquid photocurable adhesive with the liquid photocurable adhesive coating device provided in an example of this embodiment, as shown in FIG. 4 to FIG. 6, the precuring light source 102 is fixed on the coating head 101, and a light emergent direction of the precuring light source 102 coincides with an outflow direction of the liquid photocurable adhesive 202 in the coating head 102; the liquid photocurable adhesive coating device further includes: a coating head moving mechanism 103, the coating head moving mechanism 103 being connected with the coating head 101 and including a rotating mechanism 1030 configured to rotate the coating head 101; in a procedure of coating the liquid photocurable adhesive 202 on the substrate to be coated 201 with the coating head 101, the coating head moving mechanism 103 is used so that a coating velocity of the coating head 101 with respect to a coated surface 2010 of the substrate to be coated 201 is constent. Thus, the coating head 101 can form a liquid photocurable adhesive layer with a uniform thickness on the substrate to be coated 201. In addition, because the precuring light source can precure the liquid photocurable adhesive and deprive it of flowability, a liquid photocurable adhesive layer with a uniform thickness can be coated on the curved surface. It should be noted that, the above-described coating velocity refers to a moving velocity of the coating head with respect to the coated surface of the substrate to be coated, in a procedure of the coating head coating the liquid photocurable adhesive on the substrate to be coated.

Figure 8A:
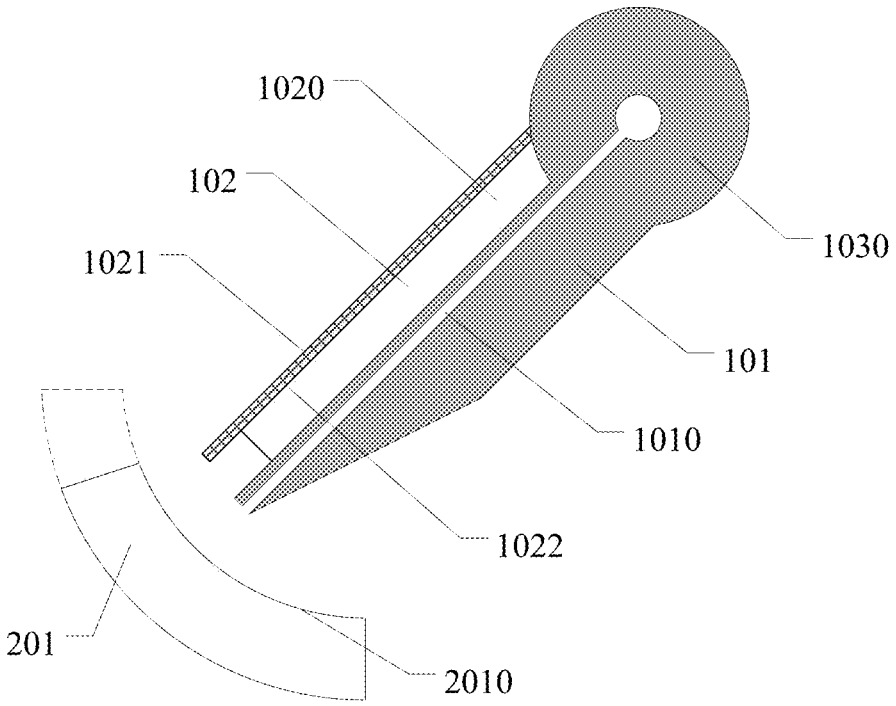
FIG. 8*a* is a schematic diagram of coating liquid photocurable adhesive on a curved surface with a liquid photocurable adhesive coating device provided by an embodiment of the present disclosure.

For example, in the method for coating the liquid photocurable adhesive with the liquid photocurable adhesive coating device provided in an example of this embodiment, as shown in FIG. 4 to FIG. 6, the coating head moving mechanism 103 further includes: a first propelling mechanism 1031 and a second propelling mechanism 1032; the first propelling mechanism 1031 being configured to make the coating head 101 to move in a first direction; and the second propelling mechanism 1032 being configured to make the coating head 101 to move in a second direction. In a procedure of coating the liquid photocurable adhesive on the substrate to be coated including the curved surface with the liquid photocurable adhesive coating device, the curved surface of the substrate to be coated can be regaded as a combination of a plurality of curved sub-surfaces with different curvatures. As shown in FIG. 8*a*, with a curved sub-surface with a curvature r as an example, the method for coating the liquid photocurable adhesive with the liquid photocurable adhesive coating device further comprises steps 210 to 230 as follows:

Step 210: determining a coating velocity V of the coating head 101 with respect to the coated surface 2010 of the substrate to be coated 201.

It should be noted that, the above-described coating velocity V may be determined according to the thickness of the liquid photocurable adhesive to be coated on the substrate to be coated. For example, when it is necessary to coat a thicker liquid photocurable adhesive, the coating velocity V may be set to be larger, and when it is necessary to coat a thinner liquid photocurable adhesive, the coating velocity V may be set to be smaller; and this embodiment includes, but is not limited thereto.

For example, when it is necessary to coat a thicker liquid photocurable adhesive, the coating velocity V may be set to be larger, and when it is necessary to coat a thinner liquid photocurable adhesive, the coating velocity V may be set to be smaller; and this embodiment includes, but is not limited thereto.

Step 220: determining an angular velocity ω of the rotating mechanism 1030 according to a distance d from a coating end point of the coating head 101 to the coated surface 2010 of the substrate to be coated 201, the curvature r of the curved sub-surface and the coating velocity V.

Figure 8B:
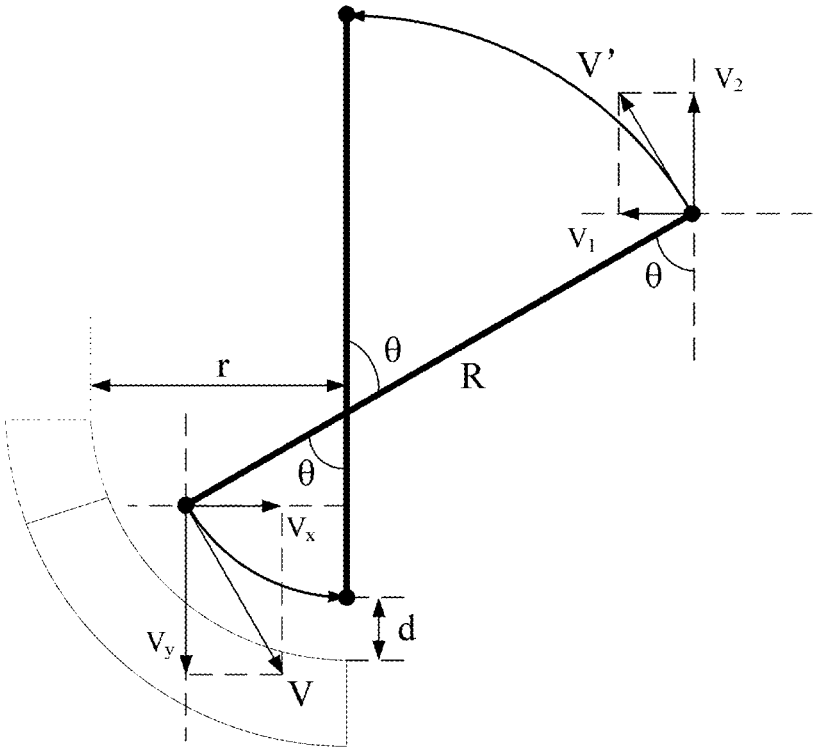
FIG. 8*b* is a path schematic diagram when the liquid photocurable adhesive coating device in FIG. 8*a* is coating liquid photocurable adhesive on a curved surface.

For example, FIG. 8*b* is a path schematic diagram when the liquid photocurable adhesive coating device in FIG. 8*a* is coating the liquid photocurable adhesive on the curved sub-surface with the curvature r. As shown in FIG. 8*b*, the coating head of the liquid photocurable adhesive coating device is perpendicular to the curved sub-surface with the curvature r, and the distance d from the coating end point of the coating head of the liquid photocurable adhesive coating device to the coated surface of the curved sub-surface with the curvature r is kept constant; because the coating velocity of the coating head with respect to the coated surface of the substrate to be coated is determined as V, the angular velocity ω of the rotating mechanism is equal to the coating velocity of the coating head with respect to the coated surface of the substrate to be coated, which is determined as V, divided by a difference between the curvature r of the curved sub-surface and the distance d from the coating end point of the coating head to the coated surface of the curved sub-surface with the curvature r, that is:

$$\omega = \frac{V}{(r-d)}$$

Step 230: as shown in FIG. 8*b*, determining velocities v1 and v2 of the first propelling mechanism and the second propelling mechanism, according to component velocities Vx and Vy of the coating velocity V in the first direction and the second direction, the distance d from the coating end point of the coating head to the coated surface of the substrate to be coated, a distance R from an axis of the rotating mechanism to the coating end point of the coating head, and the curvature r of the curved sub-surface, so that the coating velocity of the coating head with respect to the coated surface of the substrate to be coated is kept constant.

For example, as shown in FIG. 8*b*, the coating head is perpendicular to the curved surface with curvature r and the distance d from the coating end point of the coating head to the coated surface of the curved sub-surface with the curvature r is kept constant; the coating velocity of the coating head with respect to the coated surface of the substrate to be coated is determined as V, the distance from the axis of the rotating mechanism to the coating end point of the coating head is R, and therefore, a velocity component V1, in the first direction, of a velocity V' at the axis of the rotating mechanism, i.e., the velocity of the first propelling mechanism, and a component velocity V2 of the velocity V' at the axis of the rotating mechanism in the second direction, i.e., the velocity of the second propelling mechanism, satisfy a formula as follows:

$$V_1 = \frac{R-(r-d)}{(r-d)} \times V_x \quad V_2 = \frac{R-(r-d)}{(r-d)} \times V_y$$

For example, in the method for coating the liquid photocurable adhesive with the liquid photocurable adhesive coating device provided in an example of this embodiment, in a procedure of coating the liquid photocurable adhesive on the substrate to be coated with the coating head, the coating head moving mechanism is used so that the outflow direction of the liquid photocurable adhesive is perpendicular to the coated surface of the substrate to be coated.

For example, in the method for coating the liquid photocurable adhesive with the liquid photocurable adhesive coating device provided in an example of this embodiment, in the procedure of coating the liquid photocurable adhesive on the substrate to be coated with the coating head, the coating head moving mechanism is used so that the distance between the coating head and the coated surface of the substrate to be coated is kept constant.

Embodiment Three

This embodiment provides a method for coating liquid photocurable adhesive, comprising steps 310 to 320 as follows:

Step 310: coating the liquid photocurable adhesive on a substrate to be coated.

For example, the liquid photocurable adhesive may be liquid optical adhesive, photoresist, and the like.

For example, the substrate to be coated may be a cover plate of a display screen.

Step 320: precuring the liquid photocurable adhesive, so as to deprive the liquid photocurable adhesive of flowability, the coating the liquid photocurable adhesive onto the substrate to be coated and the precuring the liquid photocurable adhesive so as to deprive the liquid photocurable adhesive of flowability being performed simultaneously.

It should be noted that, the above-described precuring the liquid photocurable adhesive is not completely curing the liquid photocurable adhesive, but only curing the liquid photocurable adhesive to an extent to deprive it of flowability.

In the method for coating the liquid photocurable adhesive provided in this embodiment, the liquid photocurable adhesive coated on the substrate to be coated may be precured so as to deprive it of flowability, so that the liquid photocurable adhesive coated on the curved surface no longer flows, and coating the liquid photocurable adhesive on the curved surface can be implemented. After the liquid photocurable adhesive is coated on the substrate to be coated, the liquid photocurable adhesive may be immediately precured so as to deprive it of flowability, to ensure that it does not flow on the substrate to be coated, so as to avoid a problem of nonuniform thickness of the liquid optical adhesive.

For example, in the method for coating the liquid photocurable adhesive provided in this embodiment, the substrate to be coated includes a curved surface.

For example, the substrate to-be-coated may be a cover plate of a curved display screen.

In the method for coating the liquid photocurable adhesive provided in this embodiment, since the liquid photocurable adhesive coated on the substrate to be coated may be precured so as to deprive it of flowability, the liquid photocurable adhesive will not flow on the curved surface due to gravity, so that it is possible to implement coating liquid photocurable adhesive on the curved surface.

For example, in the method for coating the liquid photocurable adhesive provided in an example of this embodiment, in a procedure of coating the liquid photocurable adhesive on the substrate to be coated, the coating velocity is kept constant. Thus, a liquid photocurable adhesive layer with a uniform thickness can be formed on the substrate to be coated.

For example, in the method for coating the liquid photocurable adhesive provided in an example of this embodiment, in the procedure of coating the liquid photocurable adhesive on the substrate to be coated, the outflow direction of the liquid photocurable adhesive is perpendicular to the coated surface of the substrate to be coated.

For example, in the method for coating the liquid photocurable adhesive provided in an example of this embodiment, the thickness of the liquid photocurable adhesive coated on the substrate to be coated may be controlled by controlling a coating velocity and a coating air pressure. For example, when the coating air pressure is constant, and when the to-be-coated thickness is larger, the coating velocity is set to be smaller; on the contrary, when the to-be-coated thickness is smaller, the coating velocity is set to be larger. For example, when the coating velocity is constant, and when the to-be-coated thickness is larger, the coating air pressure is set to be larger; on the contrary, when the to-be-coated thickness is smaller, the coating air pressure is set to be smaller.

For example, the method for coating the liquid photocurable adhesive provided in an example of this embodiment further includes: thoroughly curing the liquid photocurable adhesive coated on the substrate to be coated. For example, the substrate to be coated may be the cover plate of the curved display screen, and after the liquid photocurable adhesive is coated on the cover plate of the curved display screen, the cover plate of the curved display screen coated with the liquid photocurable adhesive is bonded to the curved display screen; and then the liquid photocurable adhesive coated on the cover plate of the curved display screen is thoroughly cured.

There are some points to be illustrated:

(1) Drawings of the embodiments of the present disclosure only refer to structures related with the embodiments of the present disclosure, and other structures may refer to general design.

(2) In order to make it clear, in the drawings for illustrating the embodiment of the present disclosure, a thickness and a size of a layer or a microstructure is magnified. It should be understood that, when elements such as a layer, a film, a region or a substrate and the like are called to be "above" or "below" another element, the element may be directly located "on" or "beneath" the other element, or there may be an intermediate element.

(3) Without conflict, features in a same embodiment and different embodiments of the present disclosure may be combined with each other.

The above merely is specific embodiments of the present disclosure, and not intended to define the scope of the present disclosure. Any variations or replacements which can be easily thought of by those skilled in the art in the scope of the present disclosure all shall fall within the scope of protection of the present disclosure. Therefore, the scope of the present disclosure should be the scope of the following claims.

The present application claims priority of Chinese Patent Application No. 201610323302.1 filed on May 16, 2016, the present disclosure of which is incorporated herein by reference in its entirety as part of the present application.

The invention claimed is:

1. A liquid photocurable adhesive coating device, comprising:

a coating head, configured to coat a liquid photocurable adhesive;

a precuring light source, fixed on the coating head and configured to precure the liquid photocurable adhesive coated by the coating head while the coating head is coating the liquid photocurable adhesive, the device further comprises a coating head moving mechanism, wherein, the coating head moving mechanism is connected with the coating head, and includes a rotating mechanism configured to rotate the coating head, the coating head includes a liquid photocurable adhesive channel, the liquid photocurable adhesive channel includes an adhesive outlet, the precuring light source includes a light outlet, the rotating mechanism is configured to drive the coating head and the precuring light source to rotate simultaneously, so that both of a movement track of the adhesive outlet of the coating head and a movement track of the light outlet of the precuring light source are arcs, the coating head moving mechanism further includes: a first propelling mechanism, configured to move the coating head in a first direction; and a second propelling mechanism, configured to move the coating head in a second direction, wherein velocities v1 and v2 of the first propelling mechanism and the second propelling mechanism are determined, according to component velocities Vx and Vy of the coating velocity V of the coating head in the first direction and the second direction, a distance d from a coating end point of the coating head to a coated surface of a substrate to be coated, a distance R from an axis of the rotating mechanism to the coating end point of the coating head, and a curvature r of the coated surface, the liquid photocurable adhesive channel is provided in a non-center position of the coating head in the first direction such that the adhesive outlet is directly adjacent to the light outlet on a side of the coating head on which the precuring light source is fixed.

2. The liquid photocurable adhesive coating device according to claim 1, wherein, the precuring light source is configured to emit curing light beams parallel with each other.

3. The liquid photocurable adhesive coating device according to claim 1, wherein, a light emergent direction of the precuring light source coincides with an outflow direction of the liquid photocurable adhesive in the coating head.

4. The liquid photocurable adhesive coating device according to claim 3, wherein, the precuring light source is provided on an outer surface of the coating head.

5. The liquid photocurable adhesive coating device according to claim 4, wherein, the precuring light source is provided in a position of the outer surface of the coating head closest to the liquid photocurable adhesive channel.

6. The liquid photocurable adhesive coating device according to claim 1, wherein, the first propelling mechanism is connected with the rotating mechanism, the first propelling mechanism moves the coating head in the first direction by moving the rotating mechanism; the second propelling mechanism is connected with the first propelling mechanism, and the second propelling mechanism moves the coating head in the second direction by moving the first propelling mechanism.

7. The liquid photocurable adhesive coating device according to claim 1, wherein, the rotating mechanism is configured to rotate about an axis perpendicular to a plane where the first direction and the second direction are located.

8. The liquid photocurable adhesive coating device according to claim 7, wherein, a size of the light outlet of the precuring light source in a direction perpendicular to the plane where the first direction and the second direction are located is larger than or equal to a size of the adhesive outlet of the coating head in the direction perpendicular to the plane where the first direction and the second direction are located.

9. The liquid photocurable adhesive coating device according to claim 1, wherein, the first propelling mechanism includes a first-direction lead screw; and the second propelling mechanism includes a second-direction lead screw.

10. The liquid photocurable adhesive coating device according to claim 1, wherein, the precuring light source includes a laser emitter.

11. The liquid photocurable adhesive coating device according to claim 1, wherein, the precuring light source includes a curing lamp and a light-shielding plate, the light-shielding plate wrapping the curing lamp so that the precuring light source emits curing light beams parallel with each other.

12. The liquid photocurable adhesive coating device according to claim 11, wherein, a side of the light-shielding plate close to the curing lamp is provided with a reflective film.

13. A method for coating a liquid photocurable adhesive with a liquid photocurable adhesive coating device, wherein, the liquid photocurable adhesive coating device comprises: a coating head, configured to coat the liquid photocurable adhesive on a substrate to be coated; and a precuring light source, fixed on the coating head and configured to precure the liquid photocurable adhesive coated by the coating head while the coating head is coating the liquid photocurable adhesive, and the method for coating the liquid photocurable adhesive with the liquid photocurable adhesive coating device comprises:

coating the liquid photocurable adhesive on the substrate to be coated with the coating head; and precuring the liquid photocurable adhesive with the precuring light source, wherein, the coating the liquid photocurable adhesive on the substrate to be coated with the coating head and the precuring the liquid photocurable adhesive with the precuring light source are performed simultaneously, the device further comprises a coating head moving mechanism, wherein, the coating head moving mechanism is connected with the coating head, and includes a rotating mechanism configured to rotate the coating head, the coating head includes a liquid photocurable adhesive channel, the liquid photocurable adhesive channel includes an adhesive outlet, the precuring light source includes a light outlet, the rotating mechanism is configured to drive the coating head and the precuring light source to rotate simultaneously, so that both of a movement track of the adhesive outlet of the coating head and a movement track of the light outlet of the precuring light source are arcs, wherein, the substrate to be coated includes a curved surface, a light emergent direction of the precuring light source coincides with an outflow direction of the liquid photocurable adhesive in the coating head; in the coating the liquid photocurable adhesive on the substrate to be coated with the coating head, the coating head moving mechanism is configured to keep a coating velocity of the coating head with respect to a coated surface of the substrate to be coated to be constant, the coating head moving mechanism further includes: a first propelling mechanism, configured to move the coating head in a first direction; and a second propelling mechanism, configured to move the coating head in a second direction; the curved surface includes a curved sub-surface with a curvature r; and the method for coating the liquid photocurable adhesive with the liquid photocurable adhesive coating device further comprises:

determining a coating velocity V of the coating head with respect to a surface of the substrate to be coated;

determining an angular velocity ω of the rotating mechanism according to a distance d from a coating end point of the coating head to the coated surface of the substrate to be coated, the curvature r of the curved sub-surface and the coating velocity V; and determining velocities v1 and v2 of the first propelling mechanism and the second propelling mechanism, according to component velocities Vx and Vy of the coating velocity V in the first direction and the second direction, the distance d from the coating end point of the coating head to the coated surface of the substrate to be coated, a distance R from an axis of the rotating mechanism to the coating end point of the coating head, and the curvature r of the curved sub-surface, so that the coating velocity of the coating head with respect to the coated surface of the substrate to be coated is kept constant, wherein the liquid photocurable adhesive channel is provided in a non-center position of the coating head in the first direction such that the adhesive outlet is directly adjacent to the light outlet on a side of the coating head on which the precuring light source is fixed.

14. The method for coating the liquid photocurable adhesive with the liquid photocurable adhesive coating device according to claim 13, wherein, in the coating the liquid photocurable adhesive on the substrate to be coated with the coating head, the outflow direction of the liquid photocurable adhesive is made perpendicular to the coated surface of the substrate to be coated by using the coating head moving mechanism.

15. The liquid photocurable adhesive coating device according to claim 1, wherein a velocity component, in the first direction, of a velocity at the axis of the rotating mechanism is same as the velocity of the first propelling mechanism, and a component velocity of the velocity at the axis of the rotating mechanism in the second direction is same as the velocity of the second propelling mechanism.

* * * * *